US009509111B1

(12) United States Patent
Liao et al.

(10) Patent No.: US 9,509,111 B1
(45) Date of Patent: Nov. 29, 2016

(54) COAXIAL TERMINAL CRIMPING TOOL

(71) Applicant: Hanlong Industrial Co., Ltd., New Taipei (TW)

(72) Inventors: Chien-Chou Liao, New Taipei (TW); Yi-Cheng Chang, New Taipei (TW)

(73) Assignee: Hanlong Industrial Co., Ltd., New Taipei (TW)

( * ) Notice: Subject to any disclaimer, the term of this patent is extended or adjusted under 35 U.S.C. 154(b) by 0 days.

(21) Appl. No.: 15/071,242

(22) Filed: Mar. 16, 2016

(30) Foreign Application Priority Data

Oct. 22, 2015 (TW) ..... 104216946 U

(51) Int. Cl.
*H01R 43/042* (2006.01)
*B21D 39/04* (2006.01)
*B25B 27/10* (2006.01)

(52) U.S. Cl.
CPC ..... *H01R 43/042* (2013.01); *B21D 39/048* (2013.01); *B25B 27/10* (2013.01); *H01R 43/0425* (2013.01)

(58) Field of Classification Search
CPC .. H01R 9/05; H01R 43/042; H01R 43/0425; B21D 39/048; B25B 27/10
USPC ..... 72/409.14
See application file for complete search history.

(56) References Cited

U.S. PATENT DOCUMENTS 6,594,888 B2 * 7/2003 Chang ..... B25B 27/10 29/751
7,188,507 B2 * 3/2007 Holliday ..... B21D 39/048 29/282
7,797,827 B2 * 9/2010 Sutter ..... H01R 9/05 29/747
8,006,537 B2 * 8/2011 Liu ..... B25B 27/10 72/409.08
8,015,698 B2 * 9/2011 Sutter ..... H01R 9/05 29/751
9,219,342 B2 * 12/2015 Liao ..... H01R 43/0425

* cited by examiner

*Primary Examiner* — David B Jones
(74) *Attorney, Agent, or Firm* — Alan D. Kamrath; Kamrath IP Lawfirm, P.A.

(57) ABSTRACT

A coaxial terminal crimping tool comprising a first rod body, a second rod body, a connecting rod, a sliding element, and a compensation block is disclosed. One end of the second rod body is connected to one end of the first rod body. One end of the connecting rod is connected with the first rod body. The sliding element is movably combined with the second rod body and is connected to another end of the connecting rod. The compensation block comprises a combining element, a first backup plate, and a second backup plate. The combining element is combined with another end of the second rod body; the first backup plate is pivotally connected with the combining element and comprises a first opening; the second backup plate is pivotally connected with the first backup plate and comprises a second opening having an aperture different from that of the first opening.

13 Claims, 10 Drawing Sheets

COAXIAL TERMINAL CRIMPING TOOL

BACKGROUND OF THE INVENTION

1. Field of the Invention

The present invention relates to a coaxial terminal crimping tool, and more particularly, to a coaxial terminal crimping tool which can be used to crimp coaxial terminals of different sizes.

2. Description of the Related Art

A traditional coaxial terminal crimping tool often provides a compensation block having a semi-closed opening as shown in FIG. 1. The opening O of the compensation block corresponds to the crimping portion 42*a* and is formed in a U shape. Although the semi-closed opening O of the compensation block can fix a wire such that the crimping portion 42*a* can crimp a coaxial terminal to one end of the wire, the coaxial terminal is often not fully combined with the wire; i.e., the lower portion of the coaxial terminal is combined with the wire, but the upper portion of the coaxial terminal is not combined with the wire, because the fixable area provided by the U-shaped opening is less (since the upper portion of the opening O does not stop) and the coaxial terminal is made of a less-rigid material.

In order to overcome the above-mentioned deficiency, a compensation block having a closed opening is disclosed. However, presently a crimping tool using a compensation block with a closed opening can crimp only coaxial terminals of one single size and cannot crimp coaxial terminals of various sizes, which causes inconvenience for the user.

Therefore, it is necessary to propose a novel coaxial terminal crimping tool for crimping coaxial terminals of different sizes to solve the problems of the prior art.

SUMMARY OF THE INVENTION

It is an object of the present invention to provide a coaxial terminal crimping tool which can crimp coaxial terminals of different sizes and comprises a compensation block having a closed opening.

In order to achieve the above object, the present invention discloses a coaxial terminal crimping tool comprising a first rod body, a second rod body, a connecting rod, a sliding element, and a compensation block. The second rod body has a first end and a second end, wherein the first end of the second rod body is pivotally connected to one end of the first rod body. The connecting rod has one end connected with the first rod body. The sliding element is movably combined with the second rod body and connected with another end of the connecting rod, wherein the sliding element comprises a crimping portion. The compensation block comprises a combining element, a plurality of first backup plates and a plurality of second backup plates. The combining element is combined with the second end of the second rod body. The first backup plates are pivotally connected with the combining element such that each can rotate with respect to the combining element respectively, and each of the first backup plates comprises one side having a first arcuate recess; when the sides of the first backup plates having the first arcuate recesses are in contact with each other, the first arcuate recesses jointly form a closed first opening, wherein the first opening substantially corresponds to the crimping portion. Each of the second backup plates is pivotally connected with one of the first backup plates respectively such that each can rotate with respect to the first backup plate, and each of the second backup plates comprises one side having a second arcuate recess; when the sides of the second backup plates having the second arcuate recesses are in contact with each other, the second arcuate recesses jointly form a closed second opening, wherein the second opening substantially corresponds to the crimping portion, and the second opening comprises an aperture different from that of the first opening, thereby allowing wires of different sizes to go through the first and second openings and preventing coaxial terminals of different sizes from going through the first and second openings.

According to another embodiment of the present invention, the coaxial terminal crimping tool comprises a first rod body, a second rod body, a connecting rod, a sliding element, and a compensation block. The connecting rod has one end connected with the first rod body and another end connected with the second rod body. The sliding element is connected with one end of the first rod body and movably combined with the second rod body, wherein the sliding element comprises a crimping portion. The compensation block comprises a combining element, a plurality of first backup plates and a plurality of second backup plates. The combining element is combined with one end of the second rod body. The plurality of first backup plates are pivotally connected with the combining element such that each can rotate with respect to the combining element, and each of the first backup plates comprises one side having a first arcuate recess; when the sides of the first backup plates having the first arcuate recesses are in contact with each other, the first arcuate recesses jointly form a closed first opening, wherein the first opening substantially corresponds to the crimping portion. Each of the second backup plates is pivotally connected with one of the first backup plates respectively such that each can rotate with respect to the first backup plate, and each of the second backup plates comprises one side having a second arcuate recess; when the sides of the second backup plates having the second arcuate recesses are in contact with each other, the second arcuate recesses jointly form a closed second opening, wherein the second opening substantially corresponds to the crimping portion, and the second opening comprises an aperture different from that of the first opening, thereby allowing wires of different sizes to go through the first and second openings and preventing coaxial terminals of different sizes from going through the first and second openings.

According to still another embodiment of the present invention, the coaxial terminal crimping tool comprises a first rod body, a second rod body, a sliding element, and a compensation block. The second rod body is pivotally connected with the first rod body. The sliding element is connected with one end of the first rod body and the second rod body, wherein the sliding element comprises a crimping portion. The compensation block comprises a combining element, a plurality of first backup plates and a plurality of second backup plates. The combining element is connected with the end of the second rod body connecting to the sliding element and movably combined with the sliding element. The plurality of first backup plates are pivotally connected with the combining element such that each can rotate with respect to the combining element, and each of the first backup plates comprises one side having a first arcuate recess; when the sides of the first backup plates having the first arcuate recesses are in contact with each other, the first arcuate recesses jointly form a closed first opening, wherein the first opening substantially corresponds to the crimping portion. Each of the second backup plates is pivotally connected with one of the plurality of first backup plates respectively such that each can rotate with respect to the first backup plate, and each of the second backup plates comprises one side having a second arcuate recess; when the sides of the second backup plates having second arcuate recesses are in contact with each other, the second arcuate recesses jointly form a closed second opening, wherein the second opening substantially corresponds to the crimping portion, and the second opening comprises an aperture different from that of the first opening, thereby allowing wires of different sizes to go through the first and second openings and preventing coaxial terminals of different sizes from going through the first and second openings.

DETAILED DESCRIPTION OF THE PREFERRED EMBODIMENT

The advantages and innovative features of the invention will become more apparent from the following detailed description when taken in conjunction with the accompanying drawings.

Please refer to FIG. 2 to FIG. 6B for structural views of a first embodiment of a coaxial terminal crimping tool of the present invention.

Figure 1:
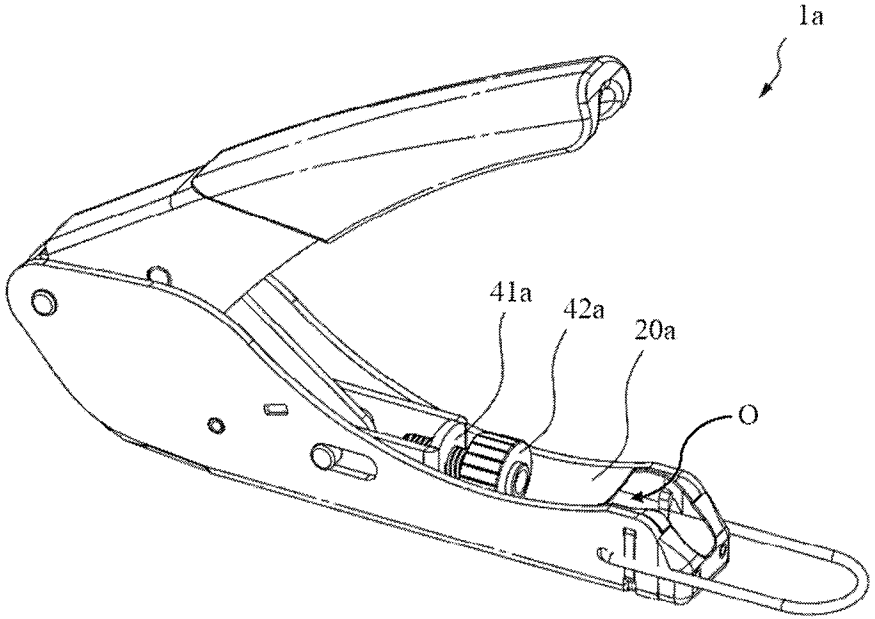
FIG. 1 illustrates a prior art coaxial terminal crimping tool.
Figure 2:
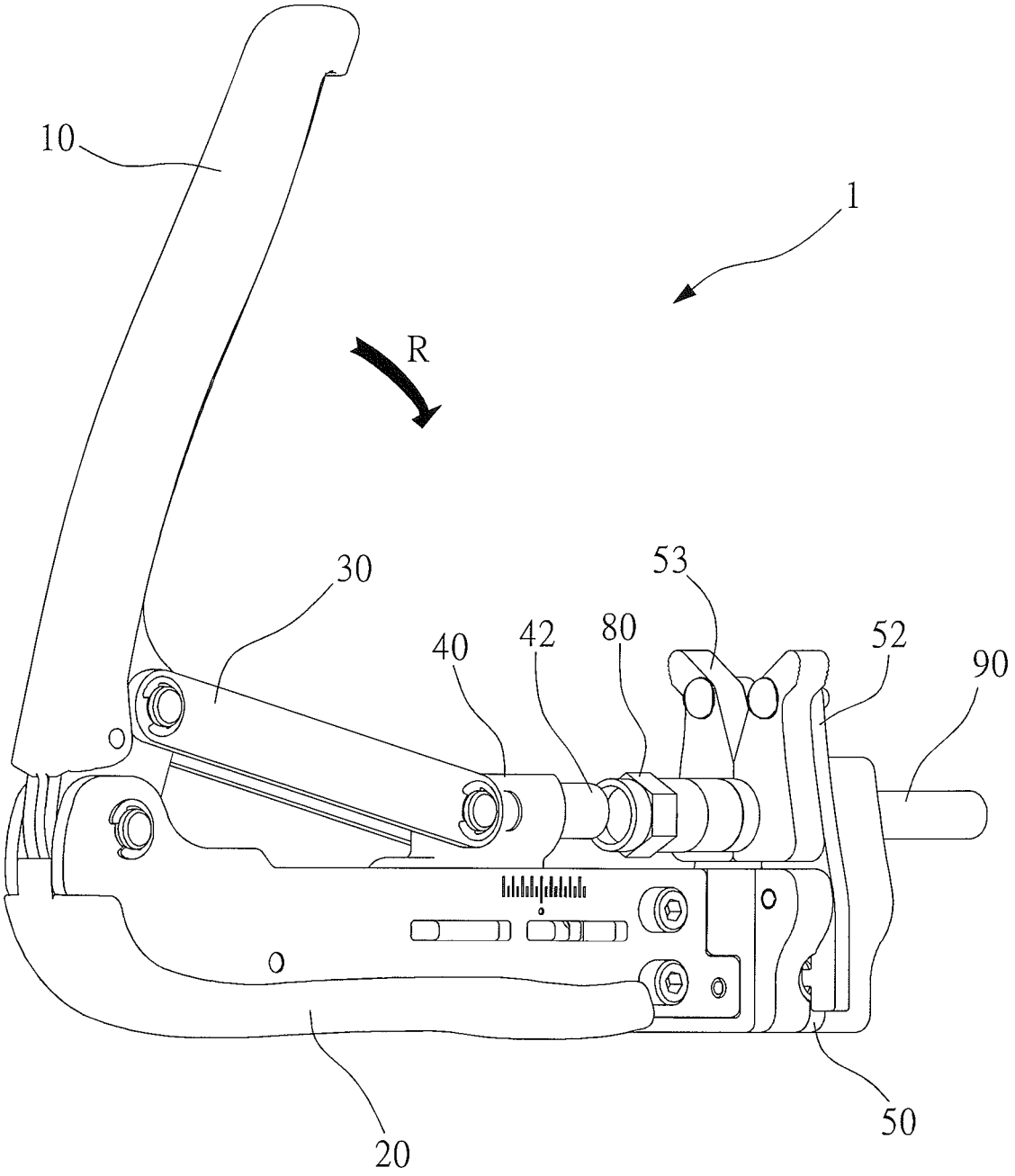
FIG. 2 illustrates a side view of a first embodiment of a coaxial terminal crimping tool of the present invention.

As shown in FIG. 2, a coaxial terminal crimping tool 1 of the present invention is used for crimping a coaxial terminal 80 to one end of the wire 90. In a first embodiment of the present invention, the coaxial terminal crimping tool 1 comprises a first rod body 10, a second rod body 20, a connecting rod 30, a sliding element 40, and a compensation block 50.

Figure 3:
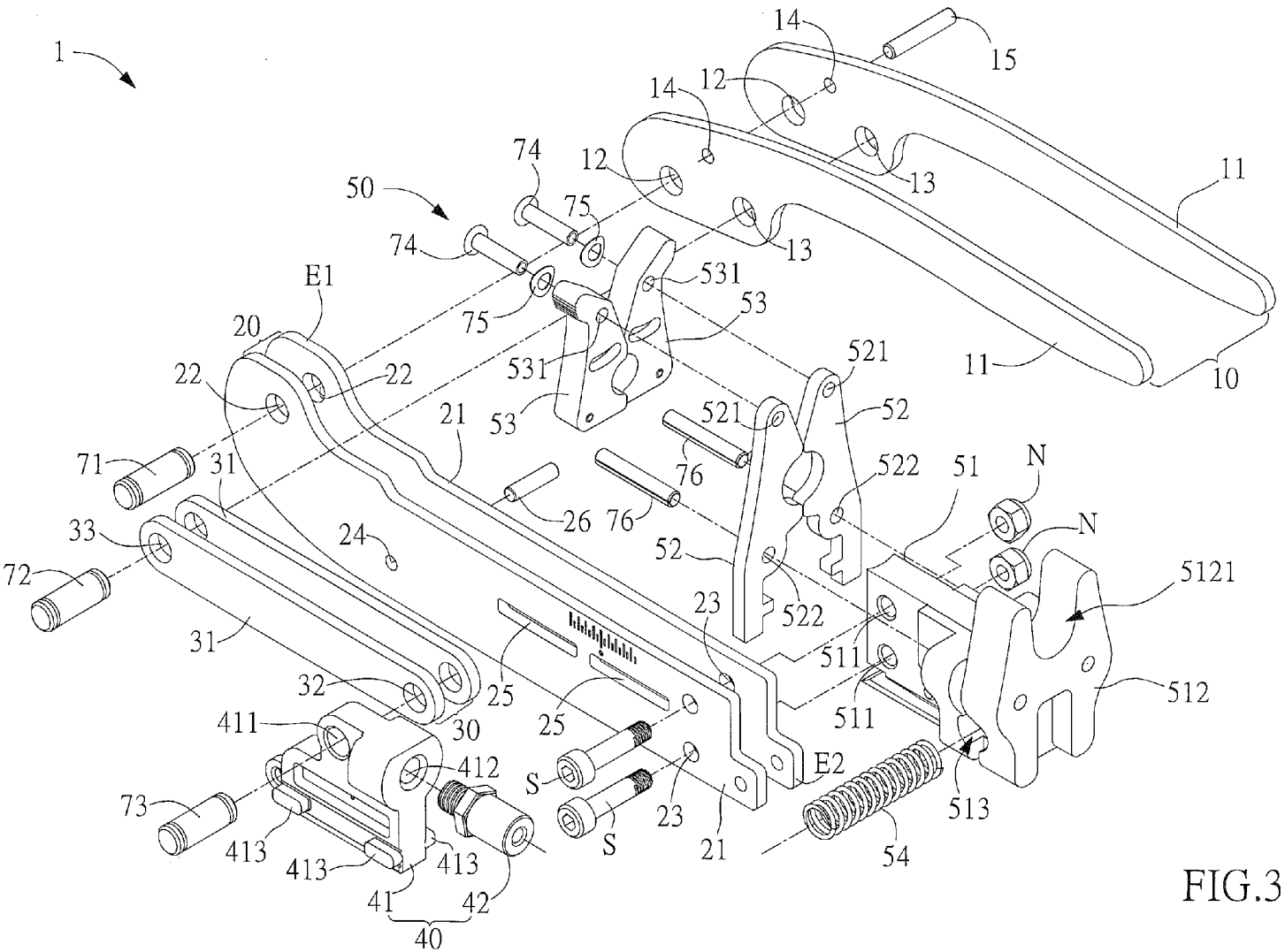
FIG. 3 illustrates an exploded view of the first embodiment of the coaxial terminal crimping tool of the present invention.

As shown in FIG. 2 and FIG. 3, in the first embodiment of the present invention, the first rod body 10 is formed by combining two first board members 11 or any other combinations. Each of the first board members 11 comprises a first pivot hole 12, a first connecting hole 13 and a first combining hole 14. The two first board members 11 are combined with each other by inserting the first combining pole 15 through the two first combining holes 14 to fix the two first board members 11.

In the first embodiment of the present invention, the second rod body 20 is formed by combining two second board members 21 or any other combinations, and the second rod body 20 comprises a first end E1 and a second end E2. Each of the second board members 21 comprises a second pivot hole 22, a second connecting hole 23, a second combining hole 24 and two sliding slots 25. The two second board members 21 are combined with each other by inserting the second combining pole 26 through the two second combining holes 24 to fix the two second board members 21. The first end E1 of the second rod body 20 is pivotally connected to one end of the first rod body 10 by the connecting pole 71 passing through the first pivot hole 12 and the second pivot hole 22.

In the first embodiment of the present invention, the connecting rod 30 is formed by combining the two rod elements 31 or any other combinations. Each of the rod elements 31 comprises a front hole 32 and a rear hole 33, wherein one end of the connecting rod 30 is connected with the first rod body 10 by the connecting pole 72 passing through the rear hole 33 and the first connecting hole 13.

In the first embodiment of the present invention, the sliding element 40 is disposed between the two second board members 21. The sliding element 40 comprises a sliding portion 41 and a crimping portion 42. The sliding portion 41 comprises a through hole 411, a threaded hole 412 and a plurality of sliding blocks 413. The sliding element 40 is connected with another end of the connecting rod 30 by the connecting pole 73 passing through the front hole 32 and the through hole 411. One end of the crimping portion 42 is screwed into the threaded hole 412 to be combined with the sliding portion 41. The plurality of sliding blocks 13 are respectively inserted into the sliding slot 25 of the second rod body 20 and can move in the sliding slot 25; therefore, the sliding element 40 is movably combined with the second rod body 20.

Figure 4:
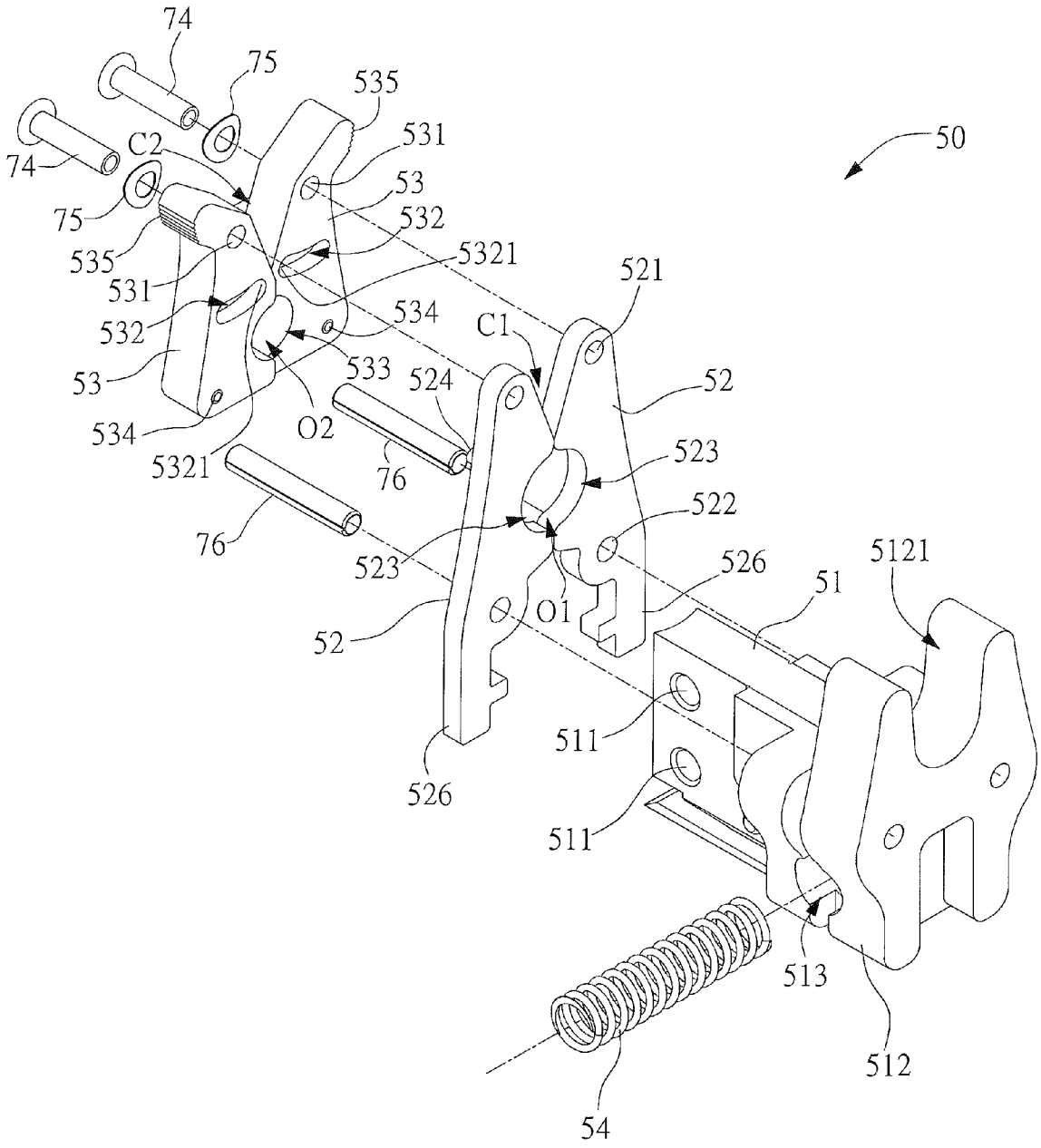
FIG. 4 illustrates a partially enlarged exploded view of the first embodiment of the coaxial terminal crimping tool of the present invention.

As shown in FIG. 3 and FIG. 4, in the first embodiment of the present invention, the compensation block 50 comprises a combining element 51, a pair of first backup plates 52, a pair of second backup plates 53, and an elastic element 54.

In the first embodiment of the present invention, the combining element 51 comprises two through holes 511, a positioning portion 512 and a mounting hole 513. The combining element 51 is combined with the second end E2 of the second rod body 20 by the screw S passing through the second connecting hole 23 and the through hole 511 and being fixed with the nut N. The positioning portion 512 comprises a recess 5121. The recess 5121 is used for containing the wire 90 (as shown in FIG. 2).

In the first embodiment of the present invention, each of the first backup plates 52 comprises two cavities 521, 522, a first arcuate recess 523, a protruding pole 524, a pit 525 (shown in FIG. 5A) and a pressing portion 526.

Figure 5A:
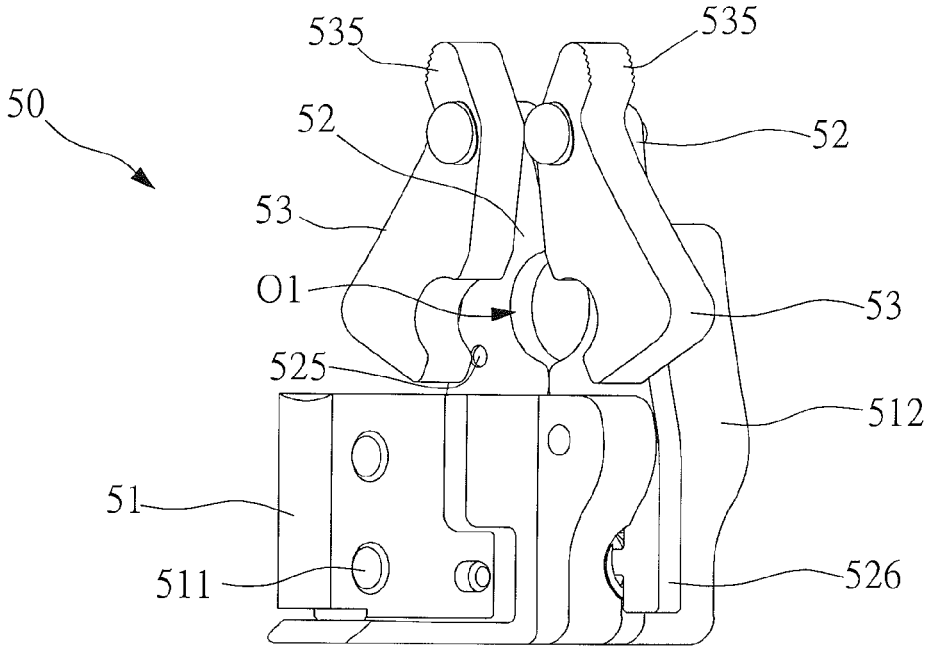
FIG. 5A illustrates a closed state view of a first backup plate of a compensation block of the coaxial terminal crimping tool.
Figure 5B:
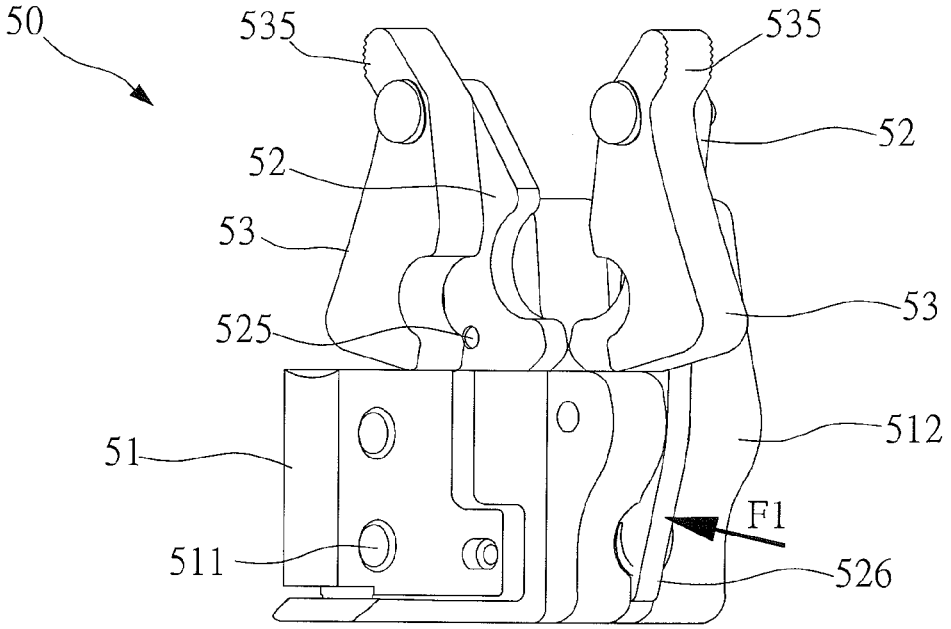
FIG. 5B illustrates an open state view of the first backup plate of the compensation block of the coaxial terminal crimping tool.

The two first backup plates 52 are pivotally connected with the combining element 51 by the fixing pole 76 passing through the cavity 522 and the cavity (not shown) of the combining element 51, thereby allowing the first backup plates 52 to rotate with respect to the combining element 51 to form a closed state (shown in FIG. 5A) or an open state (shown in FIG. 5B). When the two first backup plates 52 are in the closed state, the sides of the two first backup plates 52 having the first arcuate recesses 523 are in contact with each other, and the first arcuate recesses 523 of first backup plates 52 jointly form a closed first opening O1; meanwhile, the other sides of the first backup plates 52 corresponding to each other but not being in contact with each other jointly form a first V-shaped notch C1 adjacent to the first opening O1, wherein the first opening O1 substantially corresponds to the crimping portion 42. When the two first backup plates 52 are in the open state, the sides of the first backup plates 52 having the first arcuate recesses 523 are not in contact with each other.

In the first embodiment of the present invention, each of the second backup plates 53 comprises a cavity 531, a guide rail 532, a second arcuate recess 533, a protruding point 534 and a pushing portion 535.

The two second backup plates 53 are pivotally connected with the first backup plates 52 respectively by rivets 74 passing through the cavities 531 of the second backup plates 53 and the cavities 521 of the first backup plates 52, and each of the first backup plates 52 is disposed between the second backup plates 53 and the combining element 51. An elastic washer 75 is disposed between the head end of each rivet 74 and the second backup plate 53. Therefore, the elastic force of the washers 75 can prevent the second backup plates 53 from rotating arbitrarily without user intervention. In a specific embodiment of the present invention, the washers 75 may wave washers, but the invention is not limited to this embodiment. Each of the second backup plates 53 can rotate with respect to each of the first backup plates 52 respectively to form a closed state (shown in FIG. 6A) or an open state (shown in FIG. 6B). When the two second backup plates 53 are in the closed state, the sides of the second backup plates 53 having the second arcuate recesses 533 are in contact with each other, and the second arcuate recesses 533 of the second backup plates 53 jointly form a closed second opening O2; meanwhile, the other sides of the second backup plates 53 corresponding to each other but not being in contact with each other jointly form a second V-shaped notch C2 adjacent to the second opening O2. The second opening O2 substantially corresponds to the crimping portion 42, and the recess 5121 of the positioning portion 512 is substantially along a straight line with the first opening O1 and the second opening O2 and the recess 5121; the first opening O1 and the second opening O2 substantially correspond to the crimping portion 42. The aperture of the second opening O2 is smaller than that of the first opening O1. When the two second backup plates 53 are in the open state, the sides of the second backup plates 53 having the second arcuate recesses 533 are not in contact with each other.

The protruding poles 524 of the two first backup plates 52 are inserted into the guide rails 532 of the two second backup plates 53 respectively, wherein the guide rails 532 are provided for limiting the rotating range of the two second backup plates 53. One end of the guide rails 532 of each of the second backup plates 53 comprises a concave point 5321 for fixing the protruding pole 524 therein. When the protruding pole 524 is held fixedly in the concave point 5321, the second backup plates 53 are maintained in the open state; that is, the sides of the second backup plates 53 having the second arcuate recesses 532 are not in contact with each other (as shown in FIG. 6B).

Figure 6A:
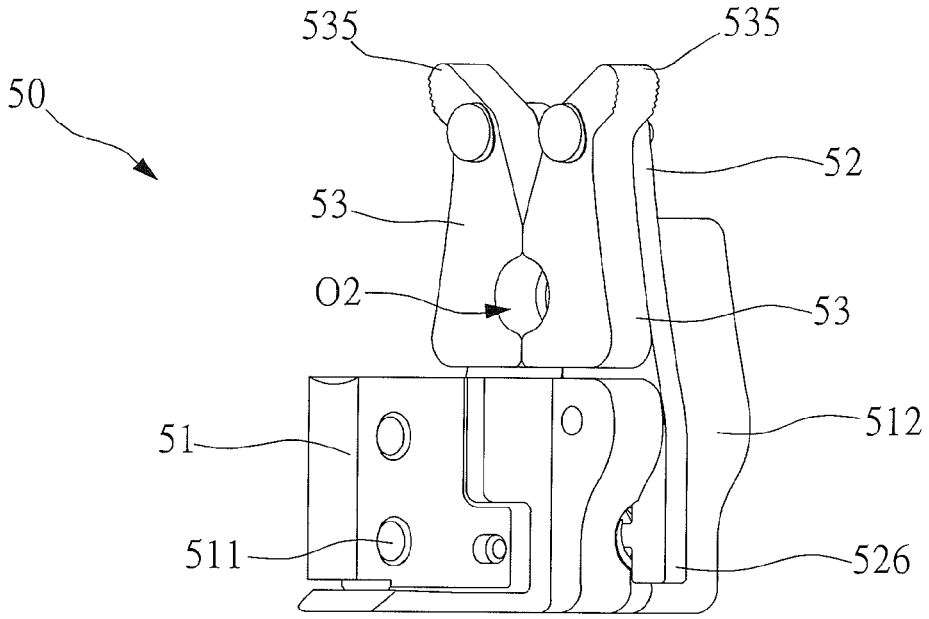
FIG. 6A illustrates a closed state view of a second backup plate of a compensation block of the coaxial terminal crimping tool.
Figure 6B:
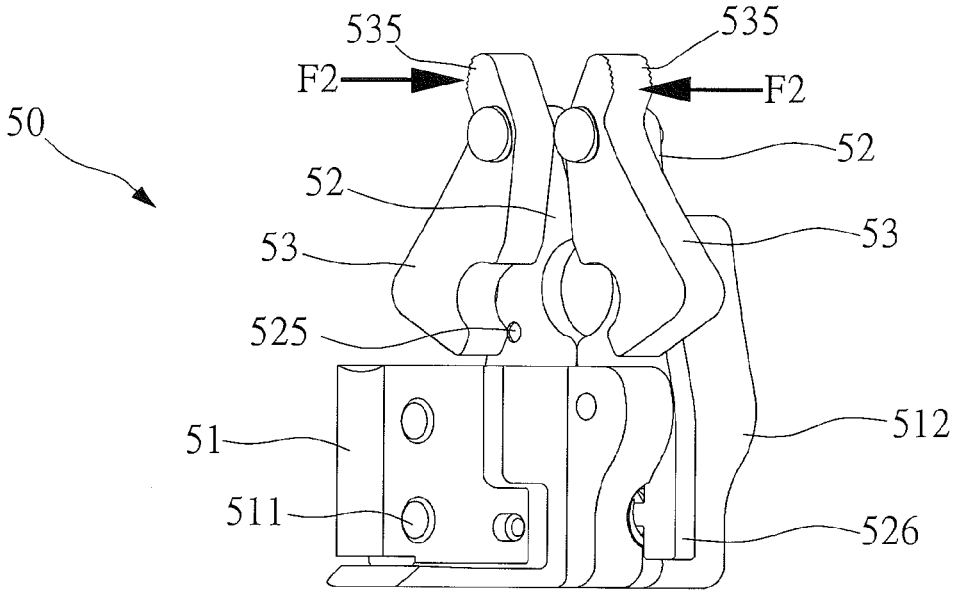
FIG. 6B illustrates an open state view of the second backup plate of the compensation block of the coaxial terminal crimping tool.

As shown in FIG. 3 and FIG. 6A-B, the pits 525 of the two first backup plates 52 are respectively provided for fixing the protruding points 534 of each of the second backup plates 53 therein. When the protruding points 534 are held fixedly in the pits 525, the second backup plates 53 are maintained in the closed state; that is, the sides of the two second backup plates 53 having the second arcuate recesses 532 are in contact with each other (shown in FIG. 6A).

The pressing portion 526 of each of the first backup plates 52 protrudes from the two opposing sides of the combining element 51 and the positioning portion 526. Users can push the pressing portion 526 (along the direction shown by the arrow F1 in FIG. 5B; the pressing portion 526 at the other side is pulled along the opposite direction of the arrow F1) to rotate each of the first backup plates 52 respectively, such that the two first backup plates 52 form the open state (shown in FIG. 5B).

The pushing portions 535 of each of the second backup plates 53 protrude out of one end of each of the first backup plates 52, and the sides of the pushing portions 535 corresponding to each other form the two sides of the second V-shaped notches C2 corresponding to each other. The user can push the two pushing portions 535 (as shown by the arrow F2 in FIG. 6B) to rotate the two second backup plates 53 respectively such that the two second backup plates 53 form the open state (shown in FIG. 6B).

As shown in FIG. 3, the elastic element 54 is disposed in the mounting hole 513 of the combining element 51, and the elastic element 54 has one end connected to one of the two first backup plates 52 and another end connected to another one of the two first backup plates 52. The elastic element 54 provides an elastic force to hold the two first backup plates 52 in the closed state. In a specific embodiment of the present invention, the elastic element 54 can be a torsion spring, but the present invention is not limited to this embodiment.

As shown in FIG. 2, when a user places a wire 90 into the first opening O1 or the second opening O2 and sleeves a coaxial terminal 80 having an aperture matching the diameter of the wire 90 to one end of the wire 90, then the user presses the first rod body 10 to cause it to rotate towards the second rod body 20 (as shown by the arrow R). During the rotation, the connecting rod 30 can drive the sliding element 40 to move towards the compensation block 50 such that the crimping portion 42 pushes the coaxial terminal 80, thereby crimping the coaxial terminal 80 and the wire 90 together by the pressing of the crimping portion 42 and the compensation block 50.

Figure 7:
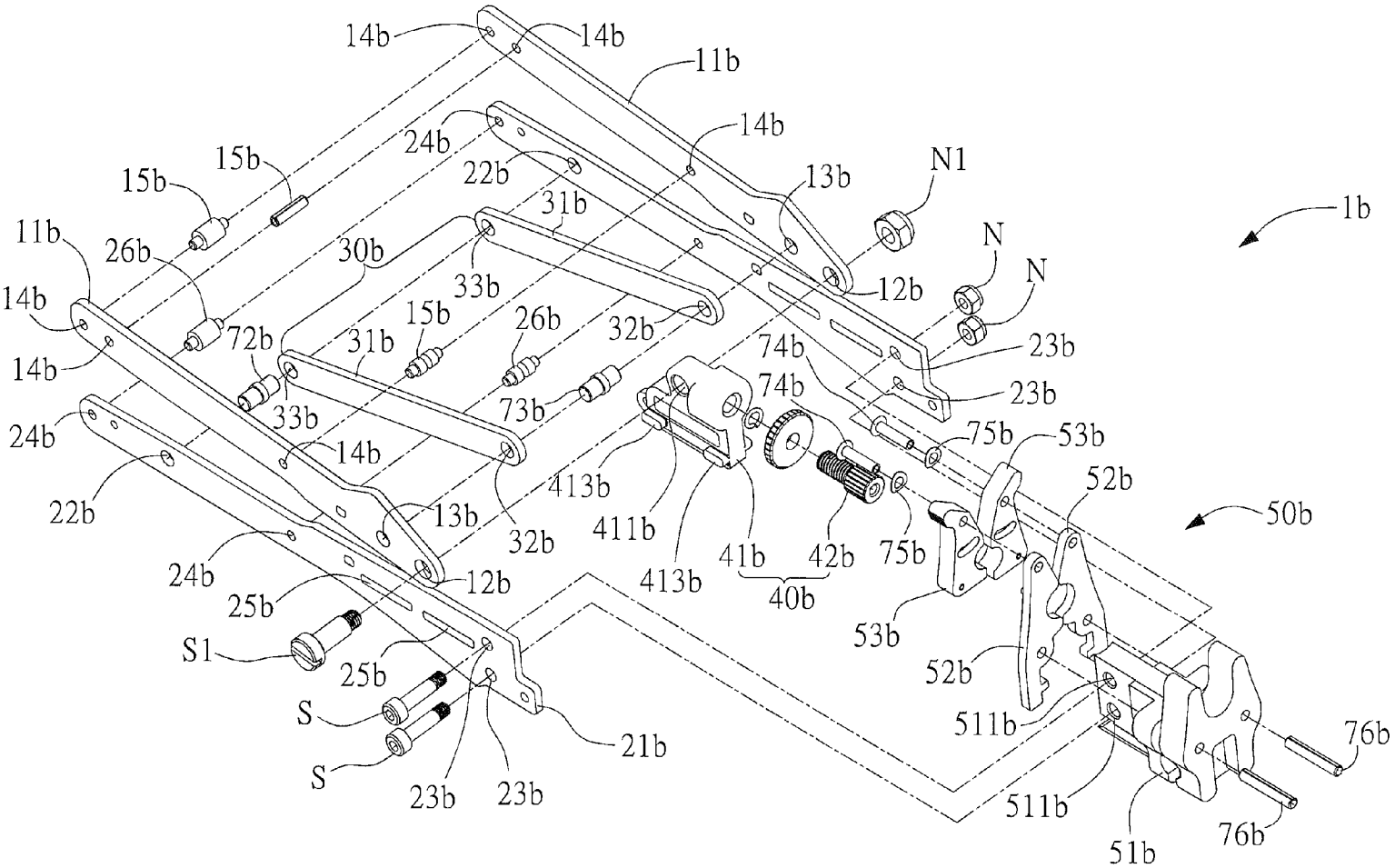
FIG. 7 illustrates an exploded view of a second embodiment of the coaxial terminal crimping tool of the present invention.
Figure 8:
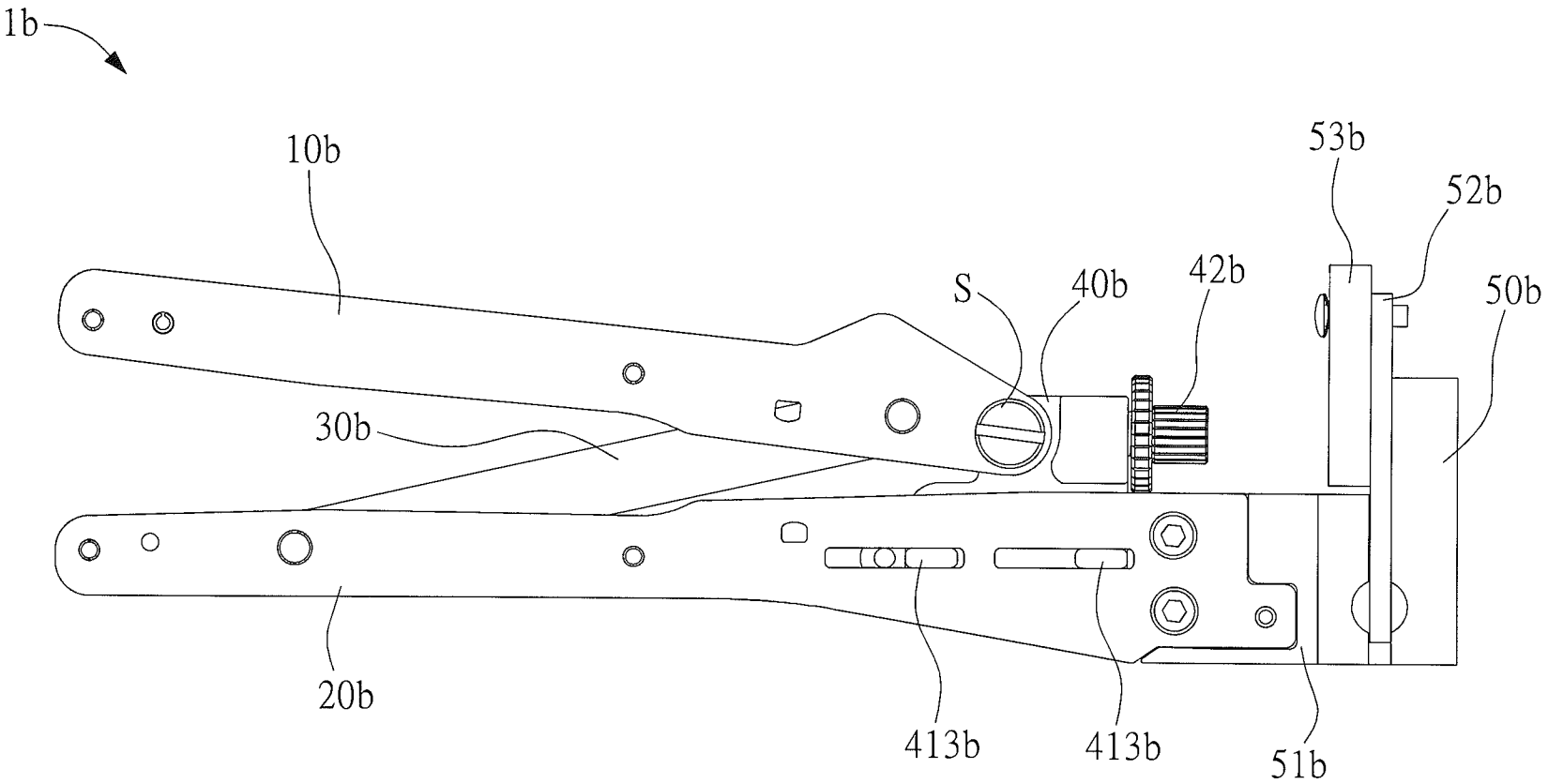
FIG. 8 illustrates a side view of the second embodiment of a coaxial terminal crimping tool of the present invention.

Next, please refer to FIG. 7 and FIG. 8 for structural views of a second embodiment of the coaxial terminal crimping tool of the present invention.

As shown in FIG. 7 and FIG. 8, in the second embodiment of the present invention, the crimping tool 1*b* also comprises a first rod body 10*b*, a second rod body 20*b*, a connecting rod 30*b*, a sliding element 40*b* and a compensation block 50*b*.

In the second embodiment of the present invention, the first rod body 10*b* is formed by combining two first board members 11*b* or any other combinations. The two first board members 11*b* are combined with each other by inserting the first combining pole 15*b* through the first combining hole 14*b* of the first board member 11*b*. The second rod body 20*b* is formed by combining two second board members 21*b* or any other combinations. The two second board members 21*b* are combined with each other by inserting the second combining pole 26*b* through the second combining holes 24*b* of the second board members 21*b*.

In the second embodiment of the present invention, the connecting rod 30*b* is formed by combining the two rod elements 31*b* or any other combinations. One end of the connecting rod 30*b* is pivotally connected with the first rod body 10*b* by the connecting pole 73*b* passing through the front hole 32*b* of the connecting rod 30*b* and the first connecting hole 13*b* of the first board member 11*b*. Another end of the connecting rod 30*b* is pivotally connected to the second rod body 20*b* by the connecting pole 72*b* passing through the rear hole 33*b* of the connecting rod 30*b* and the second pivot hole 22*b* of the second board member 21*b*.

In the second embodiment of the present invention, the sliding element 40*b* also comprises a sliding portion 41*b* and a crimping portion 42*b*, wherein the crimping portion 42*b* is combined with the sliding portion 41*b* by a screw (as in the first embodiment). The sliding element 40*b* is connected with one end of the first rod body 10*b* by the screw S1 passing through the through hole 411*b* of the sliding portion 41*b* and the first pivot hole 12*b* of the first board member 11*b* and being fixed with a nut Ni. The sliding element 40*b* is movably combined with the second rod body 20*b* by inserting the sliding block 413*b* of the sliding portion 41*b* into the sliding slot 25*b* of the second board member 21*b*.

In the second embodiment of the present invention, the compensation block 50*b* also comprises a combining element 51*b*, first backup plates 52*b*, and second backup plates 53*b*. The compensation block 50*b* is combined with one end of the second rod body 20*b* by the screw S passing through the second connecting hole 23*b* of the second board member 21*b* and the through hole 511*b* of the combining element 51*b*. In the second embodiment of the present invention, the structural features and element connection relations of the compensation block 50*b* are the same as those of the compensation block 50 described in the first embodiment. Therefore, it will not be further described for the sake of brevity.

In the second embodiment of the present invention, when a user presses the first rod body 10*b* to cause it to rotate towards the second rod body 20*b*, the first rod body 10*b* can drive the sliding element 40*b* to move towards the compensation block 50*b* to reduce the distance between the crimping portion 42*b* and the first backup plate 52 or the crimping portion 42*b* and the second backup plate 53, such that the coaxial terminal 80 and the wire 90 placed between them are fixedly combined by the pressing of the crimping portion 42 and the compensation block 50.

Figure 9:
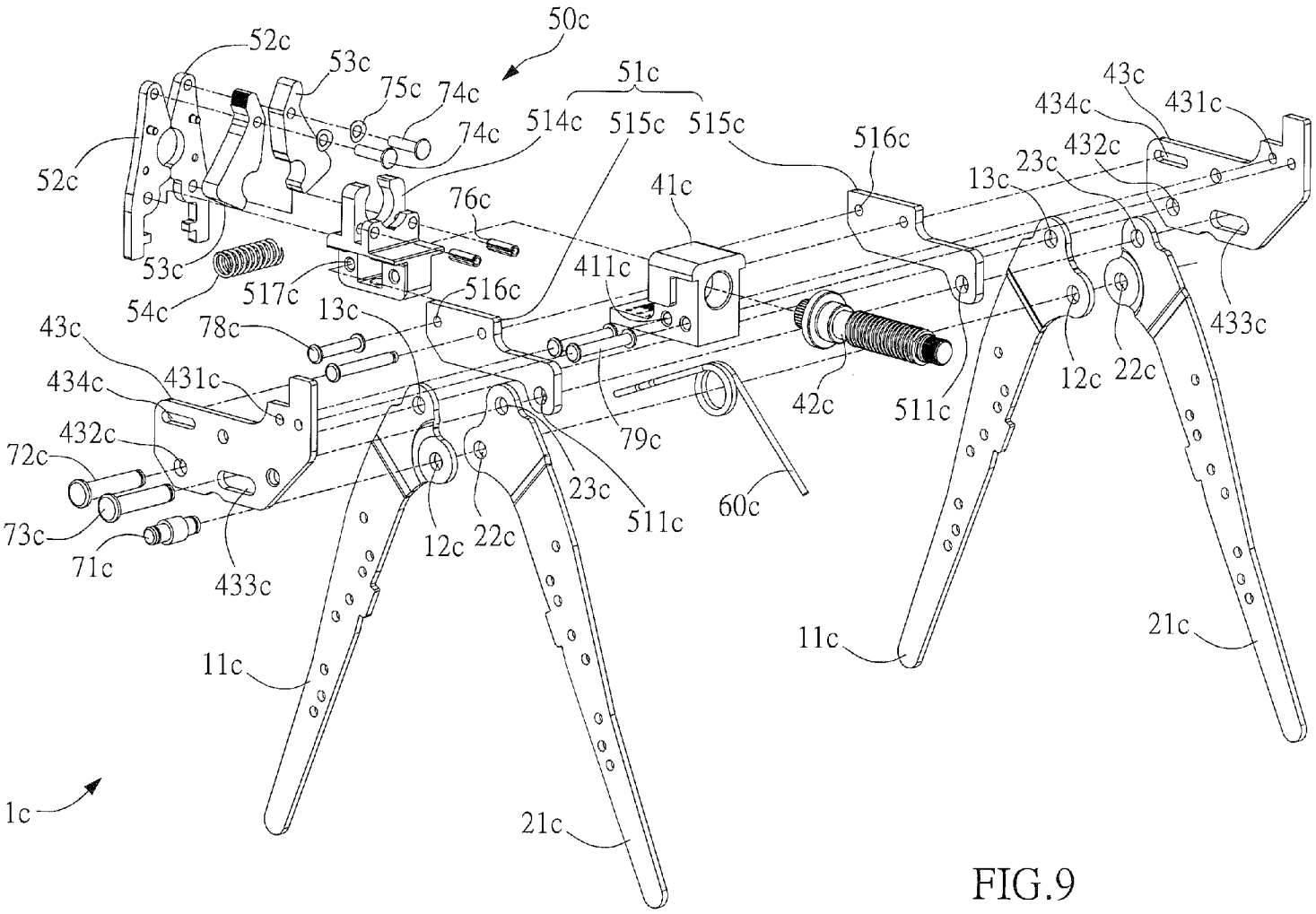
FIG. 9 illustrates an exploded view of a third embodiment of the coaxial terminal crimping tool of the present invention.
Figure 10:
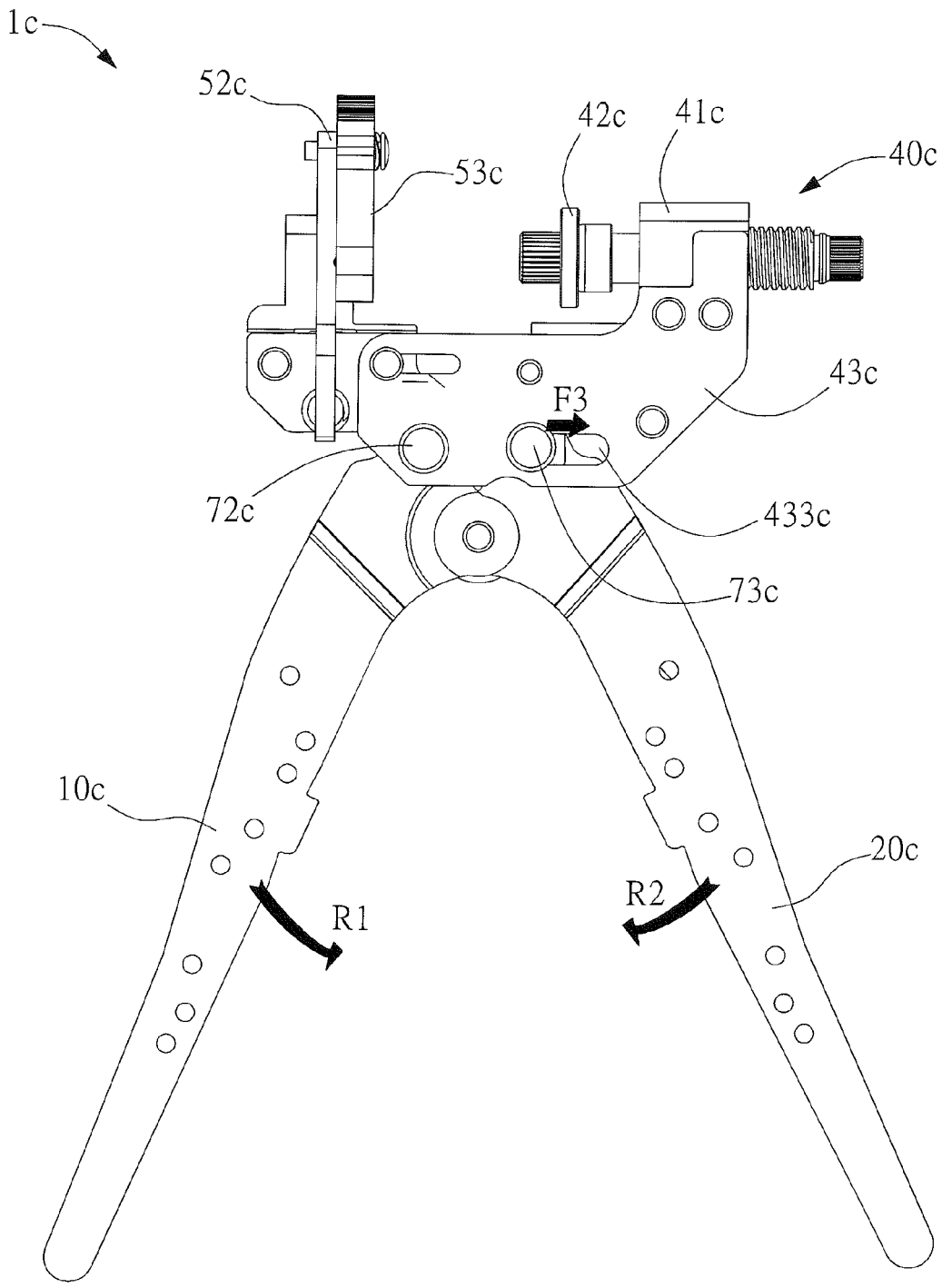
FIG. 10 illustrates a side view of the third embodiment of a coaxial terminal crimping tool of the present invention.

Finally, please refer to FIG. 9 and FIG. 10 for structural views of a third embodiment of the coaxial terminal crimping tool of the present invention.

As shown in FIG. 9 and FIG. 10, in the third embodiment of the present invention, the crimping tool 1*c* comprises a first rod body 10*c*, a second rod body 20*c*, a sliding element 40*c*, a compensation block 50*c* and a torsion spring 60*c*; that is, in the design of the third embodiment, the connecting rod is omitted.

In the third embodiment of the present invention, the first rod body 10*c* is formed by combining the two first board members 11*c*. Each of the rod elements 11*c* comprises a first pivot hole 12*c* and a first connecting hole 13*c*.

In the third embodiment of the present invention, the second rod body 20*c* is formed by combining the two second board members 21*c*. Each of the second board members 21*c* comprises a second pivot hole 22*c* and a second connecting hole 23*c*. The first rod body 10*c* and the second rod body 20*c* are pivotally connected with each other by the connecting pole 71*c* passing through the first pivot hole 12*c* and the second pivot hole 22.

In the third embodiment of the present invention, the sliding element 40*c* comprises a sliding portion 41*c*, a crimping portion 42*c* and two combining boards 43*c*. Each of the combining boards 43*c* comprises holes 431*c*, 432*c* and guide slots 433*c*, 434*c*, wherein the combining board 43*c* is combined with the sliding portion 41 by the connecting pole 79*c* passing through the hole 431*c* and the through hole 411*c* of the sliding portion 41*c*, and the two combining boards 43*c* are combined with each other by the connecting pole 72*c*.

In the third embodiment of the present invention, the compensation block 50*c* comprises a combining element 51*c*, first backup plates 52*c*, second backup plates 53*c* and an elastic element 54*c*, wherein the combining element 51*c* is formed by combining a combining block 514*c* and two connecting boards 515*c*. The two connecting boards 515*c* are combined with the combining block 514*c* by the connecting pole 78*c* passing through the holes 516*c* of the two connecting boards 515*c* and the hole 517*c* of the combining block 514*c*. Each of the connecting boards 515*c* further comprises a through hole 511*c*. The combining element 51*c* is connected with one end of the second rod body 20*c* by the connecting pole 73*c* passing through the guide slot 433*c* of each combining board 43*c*, the second connecting hole 23*c* of the second rod body 20*c*, and the through hole 511*c* of each connecting board 515*c*, and the combining element 51*c* is movably combined with the sliding element 40*c* by movement of the connecting pole 73*c* in the guide slot 433*c*.

Each of the first backup plates 52*c* is pivotally connected with the combining element 51*c* by the fixing pole 76*c*. Each of the second backup plates 53*c* is pivotally connected with each of the first backup plates 52*c* respectively by a rivet 74*c*. One end of the elastic element 54*c* is connected with one of the first backup plates 52*c*, and the other end of the elastic element 54*c* is connected with another one of the first backup plates 52*c*. Since the structural features of the first backup plates 52*c* and the second backup plates 53*c* are the same as those described in the first and second embodiment, they will not be further described for the sake of brevity.

The torsion spring 60*c* is disposed between the two first board members 11*c* and the two second board member 21*c*, and the torsion spring 60*c* provides elastic torque to the first rod body 10*c* and the second rod body 20*c*, such that the handheld portions (the portions not being connected with the sliding element 40*c*) of the first rod body 10*c* and the second rod body 20*c* are maintained in an open state.

As shown in FIG. 10, since the second rod body 20*c* is connected with the combining element 51*c* of the compensation block 50*c* and the compensation block 50*c* is movable by movement of the connecting pole 73*c* in the guide slot 433*c* (that is, the compensation block 50*c* is movably connected with the sliding element 40*c*), then when a user presses the handheld portions of the first rod body 10*c* and the second rod body 20*c* (shown by the arrows R1 and R2 in FIG. 10), the second rod body 20*c* can drive the compensation block 50*c* to move towards the sliding element 40*c* to reduce the distance between the crimping portion 42*c* and the first backup plate 52*c* or the crimping portion 42*c* and the second backup plate 53*c*, thereby allowing the coaxial terminal 80 and the wire 90 to be fixedly combined by the pressing of the crimping portion 42*c* and the compensation block 50*c*.

The first backup plates 52, 52*b* or 52*c* and the second backup plates 53, 53*b* or 53*c* of the compensation block 50, 50*b* or 50*c* can jointly form closed openings of different sizes; therefore, the present invention not only eliminates the deficiency of a compensation block with a semi-closed opening but also allows coaxial terminals 80 and wires 90 of different sizes to be crimped. Furthermore, when the first backup plates 52, 52*b* or 52*c* and the second backup plates 53, 53*b* or 53*c* are in the closed state, a first V-shaped notch C1 and a second V-shaped notch C2 are formed above the first opening O1 and the second opening O2 such that when a wire 90 is inserted into the opening from the notch, the backup plates are pushed by the wire 90 to rotate outward because the notch is V-shaped. Therefore, the user can directly insert a wire 90 into the first opening O1 or the second opening O2 from the first V-shaped notch C1 or the second V-shaped notch C2, and this design makes it more convenient for the user to quickly insert the wire 90 into the first opening O1 or the second opening O2.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. A coaxial terminal crimping tool comprising:

a first rod body;

a second rod body having a first end and a second end, wherein the first end of the second rod body is pivotally connected to one end of the first rod body;

a connecting rod having one end connected with the first rod body;

a sliding element being movably combined with the second rod body and connected with another end of the connecting rod, wherein the sliding element comprises a crimping portion; and a compensation block, comprising:

a combining element combined with the second end of the second rod body;

a plurality of first backup plates pivotally connected with the combining element such that each can rotate with respect to the combining element respectively, each of the first backup plates comprising one side having a first arcuate recess; when the sides of the first backup plates having the first arcuate recesses are in contact with each other, the first arcuate recesses jointly form a closed first opening, wherein the first opening substantially corresponds to the crimping portion; and a plurality of second backup plates, pivotally connected with the first backup plates respectively such that each can rotate with respect to each of the first backup plates respectively, each of the second backup plates comprising one side having a second arcuate recess; when the sides of the second backup plates having the second arcuate recesses are in contact with each other, the second arcuate recesses jointly form a closed second opening, wherein the second opening substantially corresponds to the crimping portion, and the second opening comprises an aperture different from that of the first opening, thereby allowing wires of different sizes to go through the first and second openings and preventing coaxial terminals of different sizes from going through the first and second openings.

2. The coaxial terminal crimping tool as claimed in claim 1, wherein each of the first backup plates comprises a protruding pole, and each of the second backup plates comprises a guide rail; the protruding pole of each first backup plate is respectively inserted into the guide rail of each of the second backup plates so as to limit the rotating range of each second backup plate.

3. The coaxial terminal crimping tool as claimed in claim 2, wherein one end of the guide rail of each of the second backup plates comprises a concave point; the concave point is provided for fixing the protruding pole therein, thereby preventing the sides of second backup plates having the second arcuate recesses from being in contact with each other by fixing of the protruding pole.

4. The coaxial terminal crimping tool as claimed in claim 1, wherein each of the first backup plates further comprises a pit, and each of the second backup plates further comprises a protruding point; the pit of each of the first backup plates is provided for fixing the protruding point of each of the second backup plates therein, thereby maintaining contact between the sides of the second backup plates having the second arcuate recesses by fixing of the protruding point.

5. The coaxial terminal crimping tool as claimed in claim 1, wherein the first opening is bigger than the second opening, and the plurality of first backup plates is disposed between the plurality of second backup plates and the combining element.

6. The coaxial terminal crimping tool as claimed in claim 1, wherein when the sides of the first backup plates having the first arcuate recesses are in contact with each other, other sides of the first backup plates corresponding to each other but not being in contact with each other jointly form a first V-shaped notch adjacent to the first opening.

7. The coaxial terminal crimping tool as claimed in claim 1, wherein when the sides of the second backup plates are in contact with each other, other sides of the second backup plates corresponding to each other but not being in contact with each other jointly form a second V-shaped notch adjacent to the second opening.

8. The coaxial terminal crimping tool as claimed in claim 1, wherein each of the first backup plates further comprises a pressing portion protruding from the two opposing sides of the combining element respectively.

9. The coaxial terminal crimping tool as claimed in claim 7, wherein each of the second backup plates further comprises a pushing portion protruding out of one end of each of the first backup plates, and the sides of the pushing portions corresponding to each other are the corresponding sides of the second V-shaped notch respectively.

10. The coaxial terminal crimping tool as claimed in claim 1, wherein the combining element comprises a positioning portion, the positioning portion comprising a recess which is substantially on a straight line with the first opening and the opening being provided for disposing a wire therein.

11. The coaxial terminal crimping tool as claimed in claim 1, wherein the compensation block further comprises an elastic element having one end connected with one of the plurality of first backup plates and another end connected with another one of the plurality of first backup plates.

12. A coaxial terminal crimping tool comprising:

a first rod body;

a second rod body;

a connecting rod having one end connected with the first rod body and another end connected with the second rod body;

a sliding element being connected with one end of the first rod body and movably combined with the second rod body, wherein the sliding element comprises a crimping portion; and a compensation block, comprising:

a combining element combined with one end of the second rod body;

a plurality of first backup plates pivotally connected with the combining element such that each can rotate with respect to the combining element respectively, each of the first backup plates comprising one side having a first arcuate recess; when the sides of the first backup plates having the first arcuate recesses are in contact with each other, the first arcuate recesses jointly form a closed first opening, wherein the first opening substantially corresponds to the crimping portion; and a plurality of second backup plates, pivotally connected with one of the first backup plates respectively such that each can rotate with respect to the first backup plate, each of the second backup plates comprising one side having a second arcuate recess; when the sides of the second backup plates having the second arcuate recesses are in contact with each other, the second arcuate recesses jointly form a closed second opening, wherein the second opening substantially corresponds to the crimping portion and comprises an aperture different from that of the first opening, thereby allowing wires of different sizes to go through the first and second openings and preventing coaxial terminals of different sizes from going through the first and second openings.

13. A coaxial terminal crimping tool comprising:

a first rod body;

a second rod body pivotally connected with the first rod body;

a sliding element connected with one end of the first rod body and the second rod body, the sliding element comprising a crimping portion; and a compensation block comprising:

a combining element connected with the end of the second rod body connecting to the sliding element and movably combined with the sliding element;

a plurality of first backup plates pivotally connected with the combining element such that each can rotate with respect to the combining element respectively, each of the first backup plates comprising one side having a first arcuate recess; when the sides of the first backup plates having the first arcuate recesses are in contact with each other, the first arcuate recesses jointly form a closed first opening, wherein the first opening substantially corresponds to the crimping portion; and a plurality of second backup plates, each of the second backup plates pivotally connected with one of the first backup plates respectively such that each can rotate with respect to the first backup plate respectively, each of the second backup plates comprising one side having a second arcuate recess; when the sides of the second backup plates having second arcuate recesses are in contact with each other, the second arcuate recesses jointly form a closed second opening, wherein the second opening substantially corresponds to the crimping portion, and the second opening comprises an aperture different from that of the first opening, thereby allowing wires of different sizes to go through the first and second openings and preventing coaxial terminals of different sizes from going through the first and second openings.

* * * * *